US005285732A

United States Patent [19]

Gottlieb

[11] Patent Number: 5,285,732

[45] Date of Patent: Feb. 15, 1994

[54] PALLET OF UNITARY CONSTRUCTION

[75] Inventor: Norman J. Gottlieb, Thornhill, Canada

[73] Assignee: Container Corporation International Ltd., Bridgetown, Barbados

[21] Appl. No.: 977,977

[22] Filed: Nov. 18, 1992

[51] Int. Cl.[5] ..... B65D 19/00

[52] U.S. Cl. ..... 108/51.3; 108/51.1

[58] Field of Search ..... 108/51.3, 51.1, 56.1

[56] References Cited

U.S. PATENT DOCUMENTS

| | | |
|---|---|---|
| 3,006,590 | 10/1961 | Hoag . |
| 3,026,015 | 3/1962 | Severn . |
| 3,026,078 | 3/1962 | Simkins . |
| 3,131,656 | 5/1964 | Houle . |
| 3,165,078 | 1/1965 | White . |
| 3,308,772 | 3/1967 | Thomas, Jr. . |
| 4,085,846 | 4/1978 | Williams . |
| 4,085,847 | 4/1978 | Jacalome . |
| 4,373,637 | 2/1983 | Shippell . |
| 4,759,295 | 7/1988 | Nilsen et al. . |
| 4,792,325 | 12/1988 | Schmidtke . |
| 4,863,024 | 9/1989 | Booth . |
| 4,867,074 | 9/1989 | Quasnick . |
| 5,001,991 | 3/1991 | Smith . |

FOREIGN PATENT DOCUMENTS

| | | |
|---|---|---|
| 628651 | 10/1961 | Canada . |
| 2319051 | 10/1974 | Fed. Rep. of Germany . |
| 1311981 | 11/1962 | France . |
| 457272 | 7/1968 | Switzerland . |
| 955035 | 4/1964 | United Kingdom . |

*Primary Examiner*—Kenneth J. Dorner
*Assistant Examiner*—Gerald A. Anderson
*Attorney, Agent, or Firm*—Shlesinger, Arkwright & Garvey

[57] ABSTRACT

There is disclosed a lightweight pallet base of unitary, one piece construction fabricated of a stiff foldable sheet material such as corrugated cardboard. In one aspect the pallet comprises a central platform having foldable corner and side flaps attached to the central platform. The corner flaps and a portion of the side edge flaps adjacent the corners are folded and interlocked to form corner support members. The central portion of the side edge support members are folded to form side edge supports located midway between the corners of the platform. The support members are of one piece construction with the central platform with the pallet being assembled from a die cut blank. Different embodiments of the unitary pallet use the foldable side edge flaps located adjacent the corner flaps in different ways to reinforce the corner support members. In another aspect a load bearing pallet tray is secured to the unitary pallet base which provides a combination having improved beam strength.

30 Claims, 12 Drawing Sheets

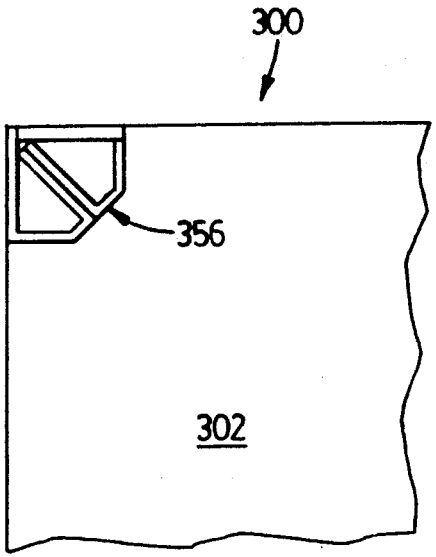
FIG. 20
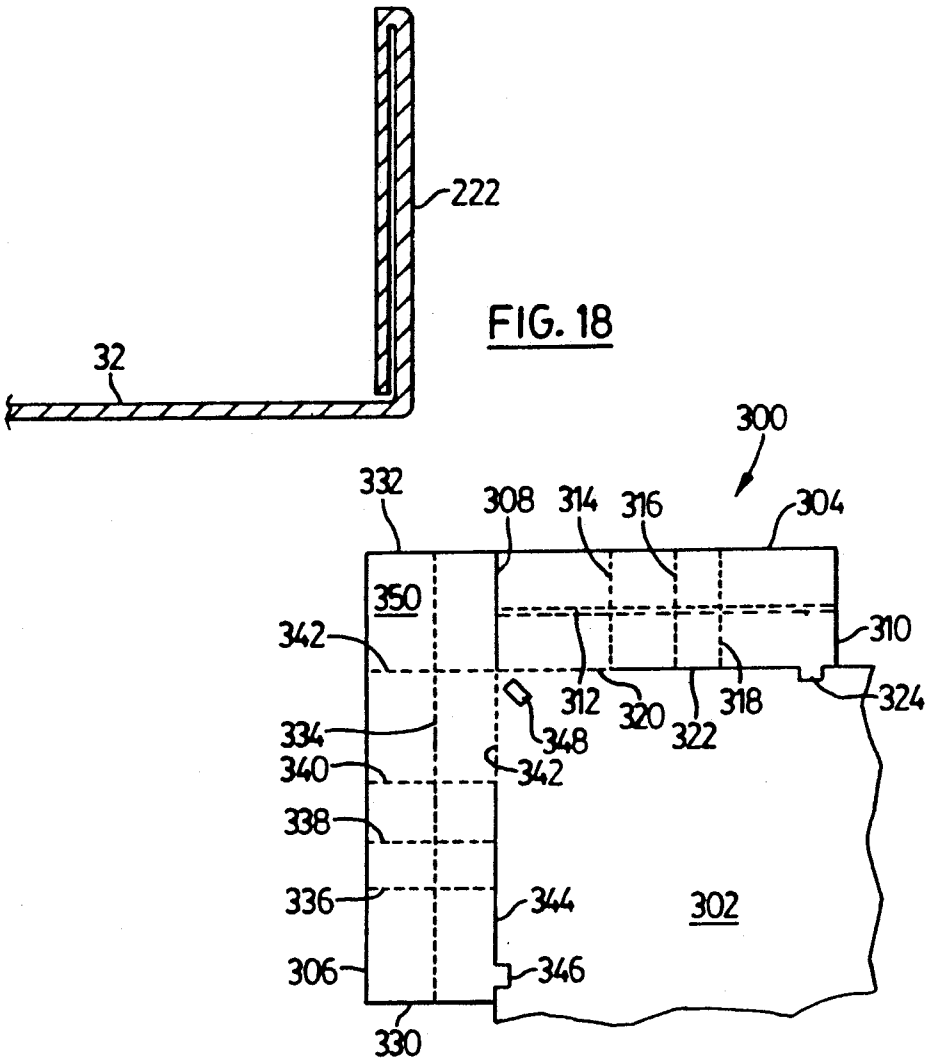
FIG. 18
FIG. 19

PALLET OF UNITARY CONSTRUCTION

FIELD OF THE INVENTION

The present invention relates to a pallet made of stiff, foldable sheet material such as corrugated cardboard.

BACKGROUND OF THE INVENTION

The need for lightweight, economical and recyclable pallets is well known. Lightweight pallets of corrugated cardboard are known with one type being disclosed in U.S. Pat. No. 4,792,325 and another disclosed in U.S. Pat. No. 4,867,074. These references disclose corrugated cardboard pallets having intersecting stringers and runners forming a platform with the stringers and runners separately constructed of multi-layered panels which are relatively expensive to produce. United Kingdom Patent No. 955,035 discloses a pallet having a paperboard load carrying platform and corner supports comprising cylindrical cores attached to the platform by strips engaging the cores and passing through slots in the corner of the platform which are secured to the top surface of the platform. A drawback to this type of pallet and other related prior art pallets is that the support members separately attached to the central platform are prone to being knocked off by e.g. the forks of a fork lift truck or all the weight of the pallet bearing down on one of the supports during movement of the pallet. Another drawback with pallets formed of different materials is that the pallets have to be disassembled and sorted prior to being recycled which increases the costs of recycling.

Accordingly, it would be advantageous to provide a pallet fabricated of a light, foldable material having a central load carrying platform and support members attached thereto of one piece or unitary construction to give an economical, lightweight and readily recyclable pallet.

SUMMARY OF THE INVENTION

In one aspect of the invention there is provided a pallet blank fabricated of a stiff foldable sheet material. The blank comprises a central platform having corner portions and side edges with the central platform having first and second opposed surfaces. The blank includes a corner flap located at each corner portion of the central platform and at least two spaced side flaps attached to each side edge of the central platform. Each side flap on each side edge has a first end adjacent a corner flap and a second end opposed to the first end. The corner flaps and side flaps are of one piece unitary construction with the central platform. Each side flap is attached to the central platform side edge along a first fold line extending from the first end to a first position spaced from the second end of the side flap. Each side flap is detached from the central platform along a cut line extending from the first position to said second end, the corner flaps and the side flaps being foldable out of plane of the central platform. Each corner flap is foldable to overlap itself and securable in a position extending out of the plane of the central platform The second ends of the side flaps are foldable towards and inwardly of the adjacent corner flap and are securable to the central platform. The foldable corner flap and the adjacent foldable side flaps form a corner support member extending out of the plane from the central platform when the pallet blank is assembled into a pallet.

In another aspect of the invention there is provided a pallet fabricated of a stiff foldable sheet material comprising a generally rectangular central platform having corner portions and side edges. The central platform has opposed first and second surfaces. Included is a corner support member at each corner portion of the central platform comprising the assembled combination of a corner flap located at each corner portion of the central platform and a side flap attached to the side edge of the central platform on each side of the corner flap. Each side flap on each side edge has a first end located adjacent the corner flap and a second end opposed to the first end. The corner flaps and side flaps are of one piece construction with the central platform. Each side flap is partially attached to the central platform side edge along a fold line extending from the first end to a first position spaced from the second end of the side flap. The corner flaps and the side flaps are folded in a direction of the plane of the central platform. In the assembled combination each corner flap is folded to overlap itself and secured in position to extend out of the plane of the central platform. The second ends of the side flaps are folded towards and inwardly of the adjacent corner flap and are secured to the central platform.

BRIEF DESCRIPTION OF THE DRAWINGS

The following is a description, by way of example only, of various embodiments of the unitary pallet of the present invention, reference being had to the accompanying drawings, in which:

FIG. 18 is a sectional view along the line 16—16 of FIG. 16 after the side wall has been assembled from the blank;

FIG. 19 a plan view, broken away, of another cardboard blank prior to assembly into a third embodiment of a unitary pallet base according to the present invention;

FIG. 20 is a plan view, broken away, of the assembled corner support of the blank of FIG. 19.

DETAILED DESCRIPTION OF THE INVENTION

Figure 1:
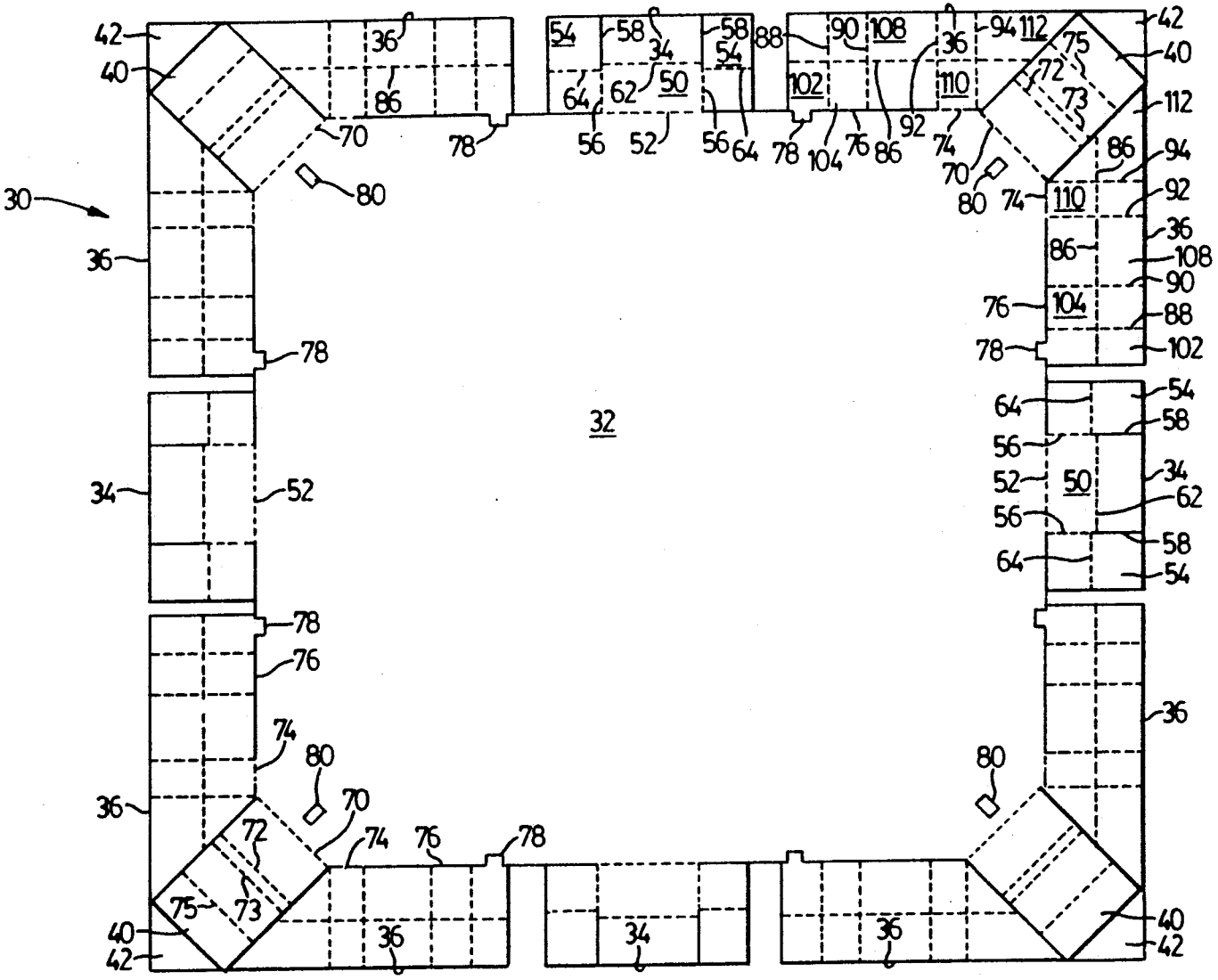
FIG. 1 is a plan view of a cardboard blank prior to assembly into a first embodiment of a unitary pallet base forming the subject invention.
Figure 2:
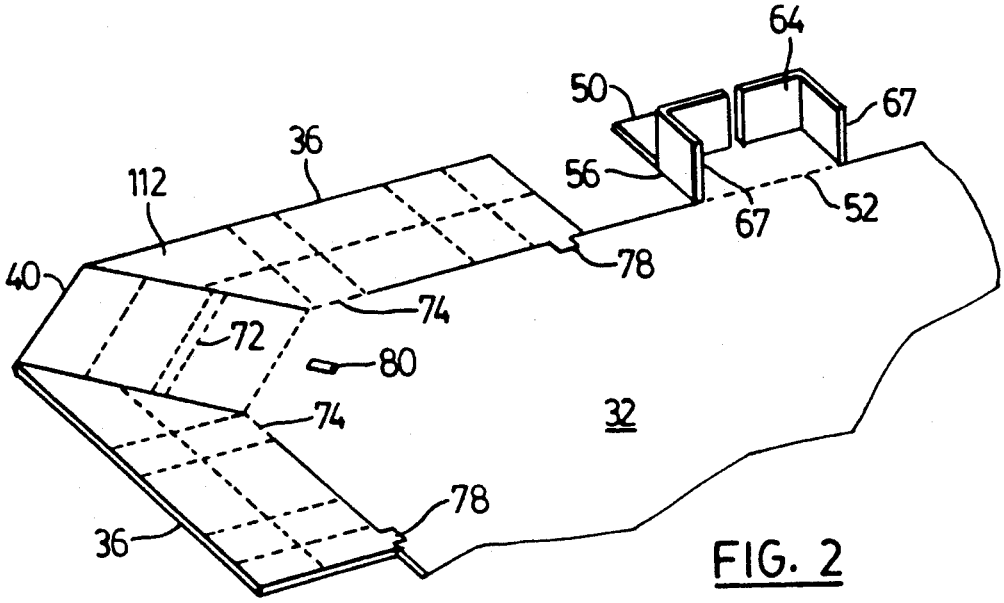
FIGS. 2 to 8 are perspective views of a corner and a mid section along one edge of the blank of FIG. 1 showing the various stages of assembly of a first embodiment of a unitary pallet embodying the subject invention.
Figure 3:
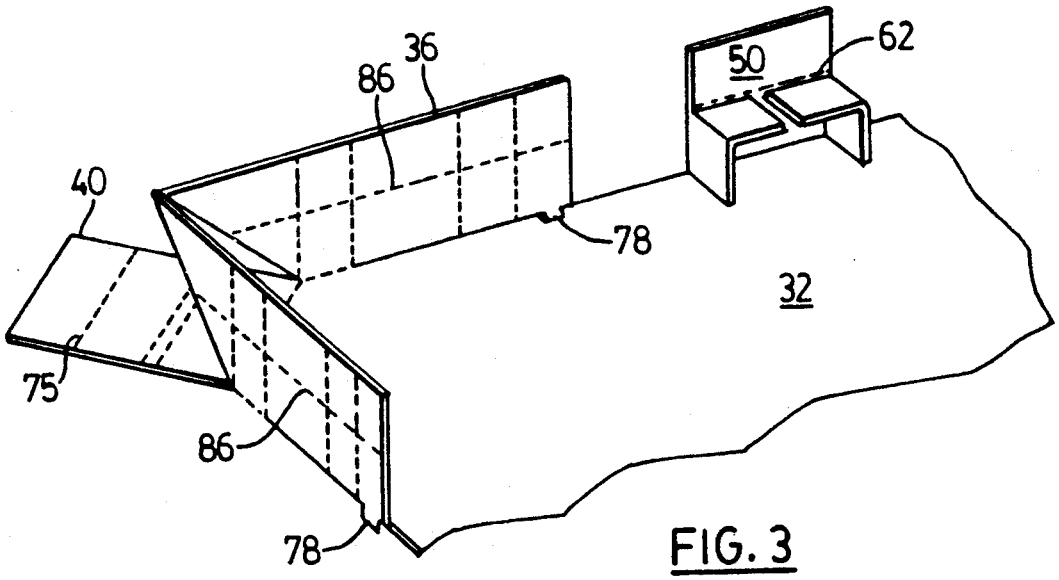

In the ensuing description of the structure and operation of the pallet embodying the subject invention, reference will be made to the drawings wherein like numerals refer to like parts. Referring first to FIG. 1, a generally rectangular die cut blank 30 of a first embodiment of a pallet base comprises a central support area or platform 32 bounded on each side by three spaced, flaps including a central flap 34 and two side flaps 36 located on either side of flap 34 adjacent the corners of the platform. Blank 30 is preferably fabricated of a stiff, foldable sheet material such as corrugated cardboard. Corner panels 40 are located at the corners of blank 30 between side flaps 36 on adjacent sides of the blank. The solid lines in FIG. 1 represent cut lines extending through blank 30 so that after being die cut, triangular corner portions 42 are discarded. The broken lines in FIG. 1 represent crease or fold lines so that central flaps 34 each comprise a central panel 50 attached to platform 32 along a fold line 52. Located on each side of central panel 50 is a panel 54 attached to central panel 50 along a fold line 56 which is collinear with a cut line 58 extending to the outer edge of flap 34 thereby separating the outermost portions of panels 50 and 54. Panel 50 is provided with a fold line 62 extending transversely thereacross and panels 54 are foldable along fold lines 64 extending transversely thereacross which are parallel to but offset from fold line 62 by an amount approximately equal to the thickness of blank 30.

Each corner panel 40 is attached to central platform 32 along fold line 70 and the corner panel comprises a pair of parallel crease or fold lines 72, 73 extending transversely thereacross and spaced from each other about three times the thickness of blank 30. Another fold line 75 extends across the width of panel 40 spaced from lines 72, 73 so that when panel 40 is folded there are three panel subportions adjacent each other. Side flaps 36 are separated from central platform 32 partly by a fold line 74 extending from the corner of panel 40 and partly by a cut line 76 collinear with fold line 74 wherein cut line 76 defines positioning tab 78. An aperture 80 spaced from fold line 70 is provided for receiving therein positioning tabs 78. Each side flap 36 comprises a longitudinal fold line 86 and four spaced fold lines 88, 90, 92 and 94 extending transversely thereacross which define four rectangular panels 102, 104, 108, 110 and a triangular panel 112 located adjacent panel 40.

The various stages or steps in the assembly of a pallet base from blank 30 are illustrated in FIGS. 2 to 9. The various panels comprising central flaps 34 are folded along fold lines 56, 64 and 62 to form a central side edge pallet support shown generally at 100 in FIGS. 4, 6 and 8. Glue or other adhesive is applied to the surfaces of panels 50 and 54 which contact each other when assembled as shown generally at 63 in FIG. 10. In addition, glue is applied along edges 67, best seen in FIG. 2, for bonding panels 54 to central platform 32.

Figure 4:
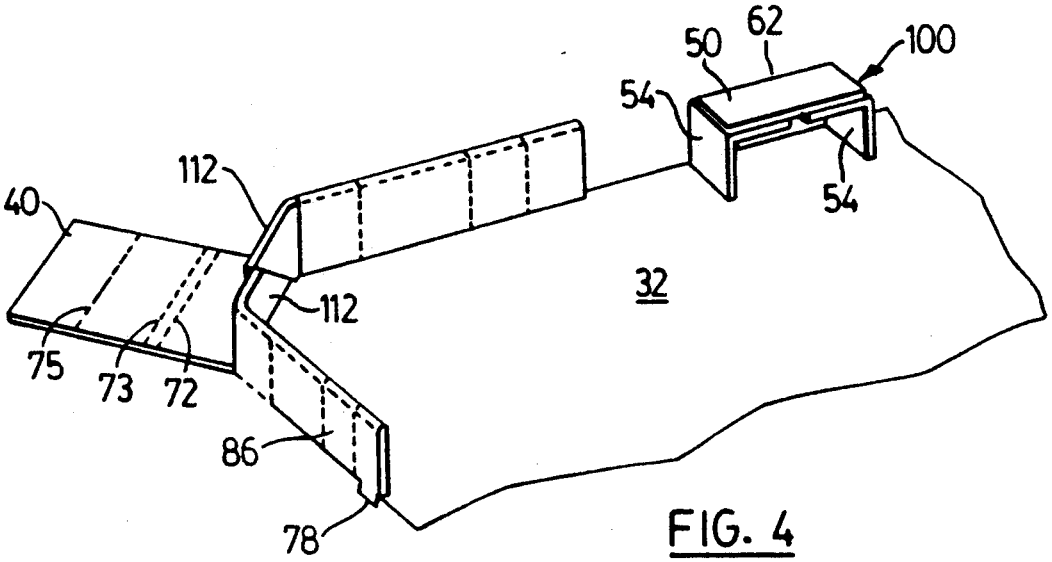
Figure 5:
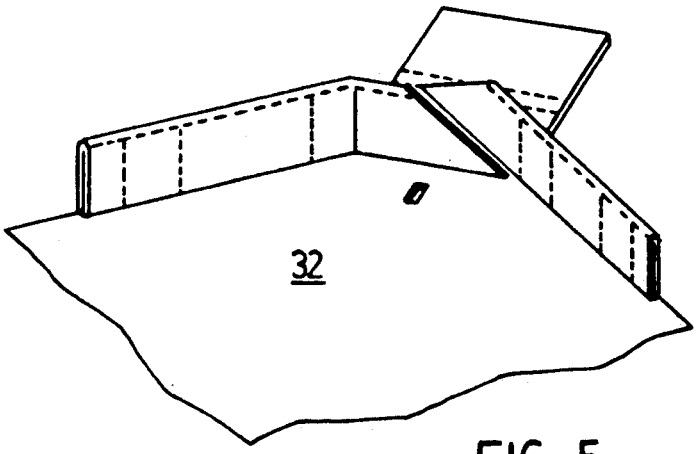
Figure 9A:
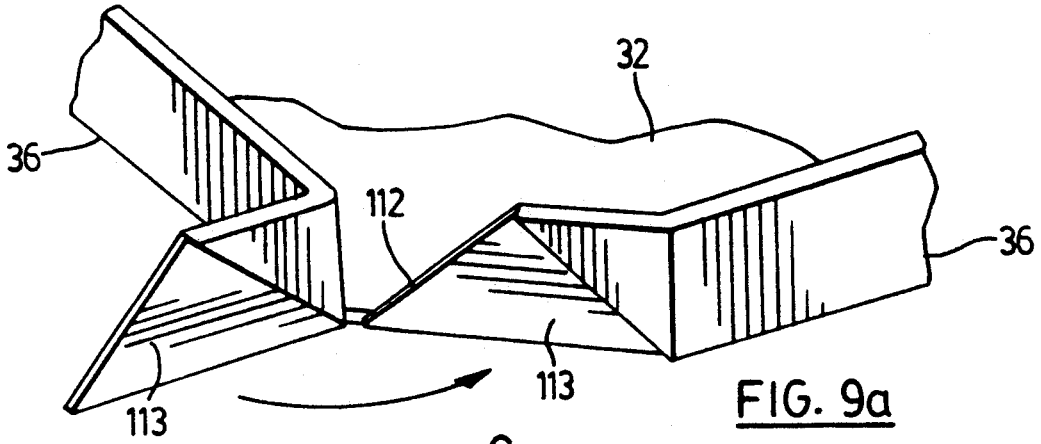
FIG. 9*a* is a perspective view, broken away, along arrow 9 of FIG. 6.
Figure 9B:
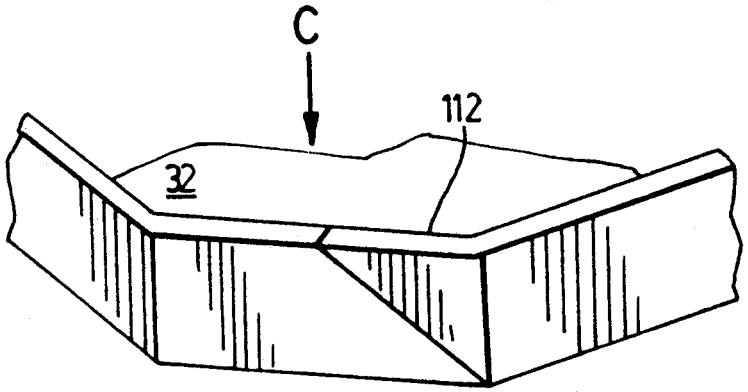
FIG. 9*b* is a perspective view, broken away, similar to FIG. 9*a* but showing the end flaps assembled.
Figure 9C:
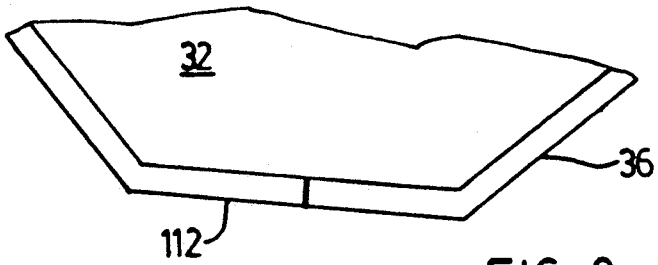
FIG. 9*c* is a plan view, along arrow c of FIG. 9*b;*
Figure 10:
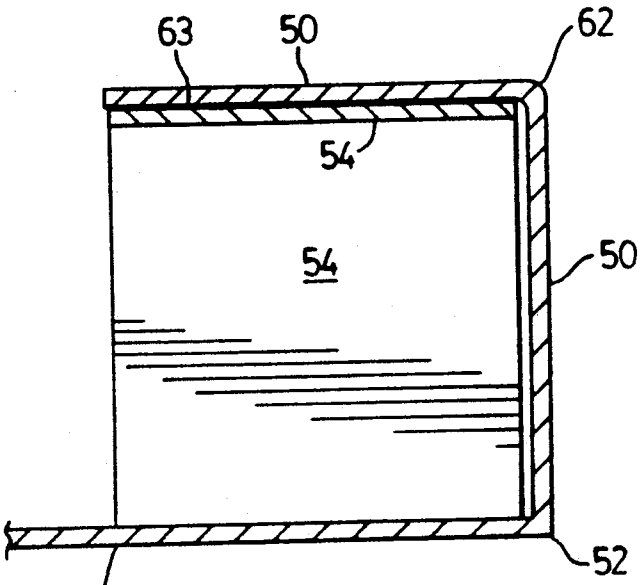
FIG. 10 is a sectional view along the line 10— 10 of FIG. 6.

End flaps 36 are folded along longitudinal fold lines 86 and the resulting double thickness flap folded up along fold lines 74 to extend out of the plane of platform 32 as shown in FIGS. 4 and 5. Referring to FIGS. 9*a*, 9*b* and 9*c* (being a plan view), the two triangular panels 112 adjacent the corners of central platform 32 are overlapped together with the single thickness portions 113 overlapping as shown so that the two panel portions 112 projecting across the corner portion of platform 32 overlap and fit together to form a double thickness corner reinforcement.

Figure 7:
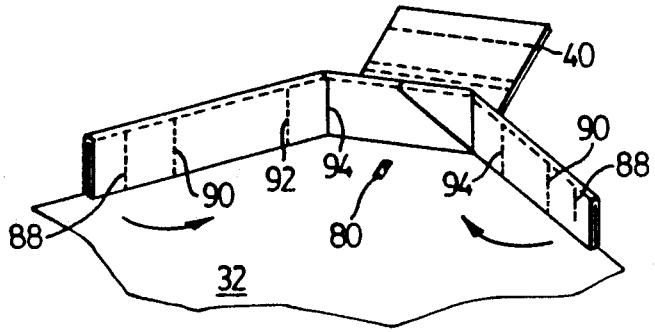
Figure 8:
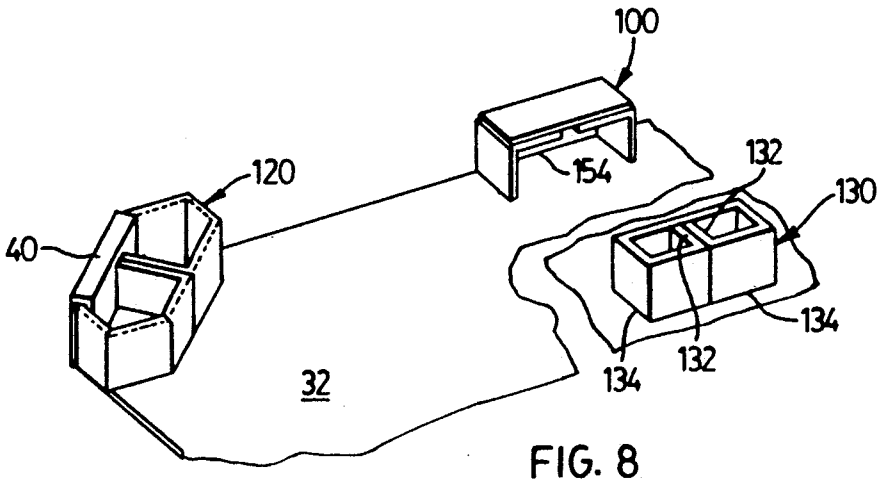
Figure 6:
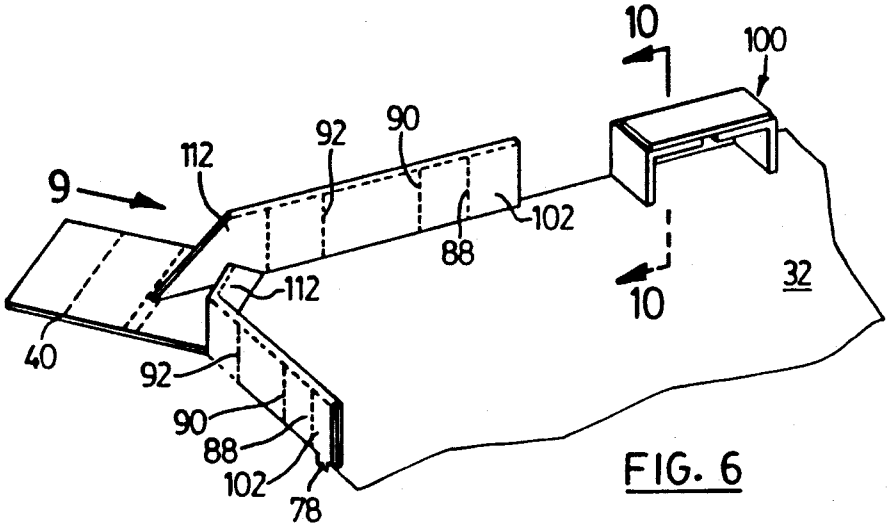

Referring to FIGS. 6 to 8, the free ends of overlapped flaps 36 on either side of panel 40 are folded along fold lines 88, 90, 92 and 94 inwardly towards the corner of platform 32 and positioning tabs 78 are inserted into aperture 80 to form a unitary, hexagonally shaped corner support 120 for the pallet base. The outer surfaces of the portions of end panels 102 to which tabs 78 are integrally attached are coated with glue or other adhesive so that when the two end panels are placed adjacent each other they bond together, thereby securing corner support 120 in position. Panel 40 is folded up and over the matched triangular panels 112 as best seen in FIG. 8.

Referring specifically to FIG. 8, a central support member 130 comprises a strip of cardboard folded into a rectangular "figure eight" shape with the adjacent faces of the two end panels 132 glued together. Support member 130 is glued to the bottom of central platform 32 in the middle thereof along an edge 134 of the support member.

Figure 11:
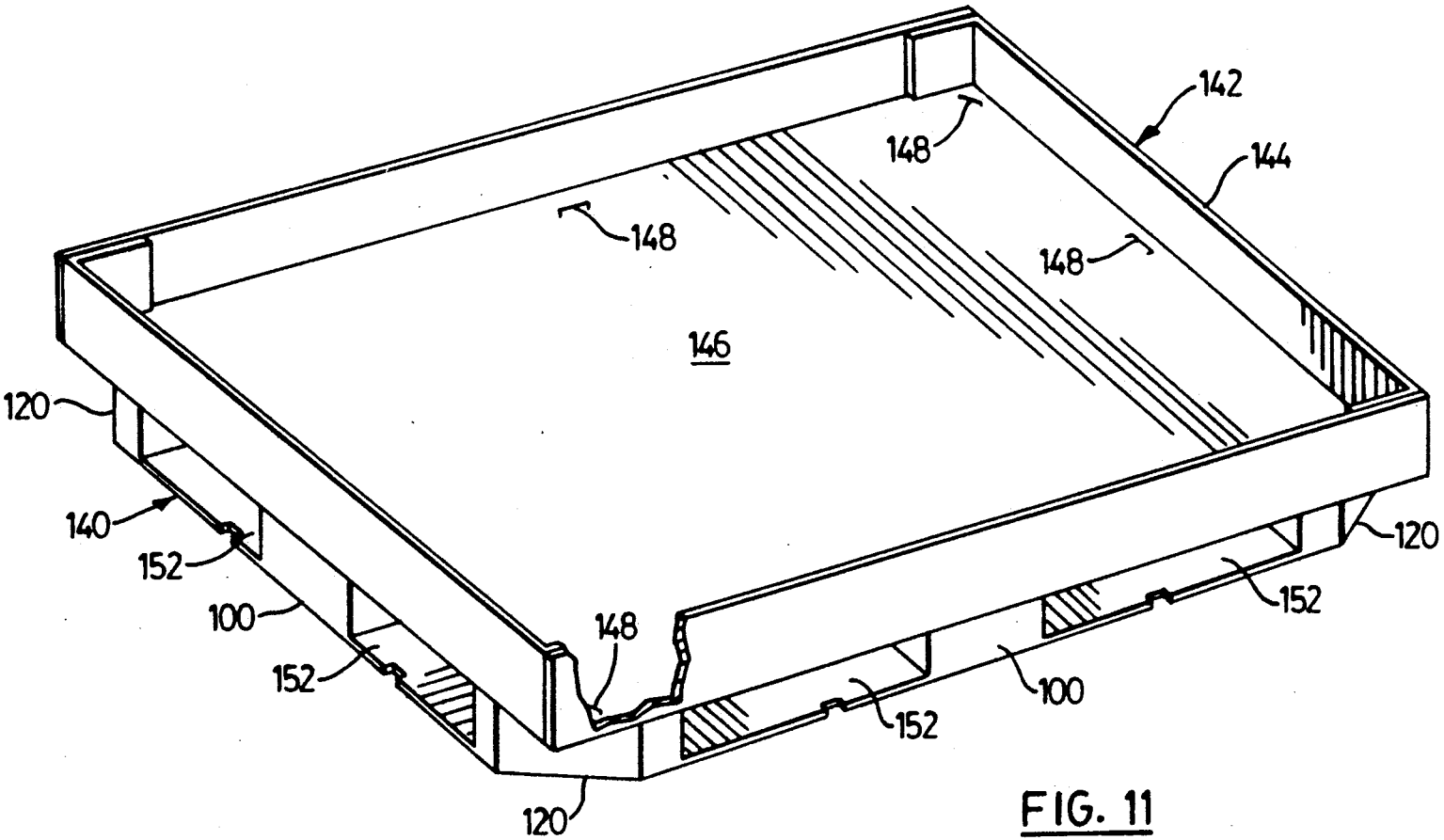
FIG. 11 is a perspective view, broken away, of a tray mounted on the assembled pallet base formed from the blank shown in FIG. 1.

Referring to FIG. 11, when support members 120 at all the corners of the pallet base have been assembled and central support member 130 attached to the central portion of platform 32 to form an assembled pallet base 140, a load bearing tray 142 comprising sides 144 and base 146 may be secured to the pallet base as shown so that base 146 acts as the load bearing surface. Tray 142 may be secured to pallet base 140 by stapling the tray to support members 100 and 120, the staples being shown at 148. Alternatively, an adhesive may be used to attach tray 142 to support members 100 and 120. When pallet base 140 and tray 142 are coupled together, a pair of spaced passageways 152 are formed on each side of the assembled pallet which are for receiving therein the forks of a fork lift truck. Referring to FIG. 8, side edge support members 100 may be reinforced with a stack of cardboard, not shown, placed in rectangular aperture 154.

In an alternative embodiment, pallet base 140 may be used as the pallet directly by turning over the base as shown in FIG. 8 without tray 142 attached thereto so that support members 100, 120 and 130 directly engage the supporting surface. In this embodiment the load bearing surface is the bottom face of central platform 32 which is now raised above the supporting surface.

Figure 15:
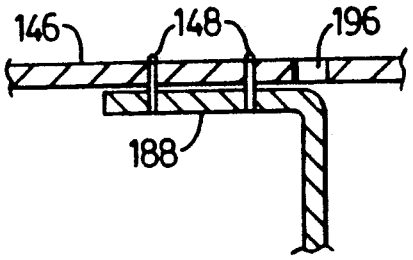
FIG. 15 is a perspective view along the line 15—15 of FIG. 13.
Figure 14:
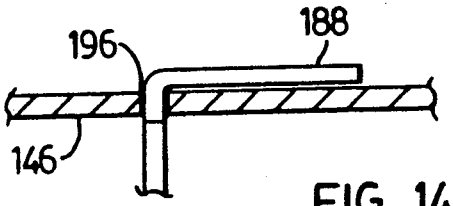
FIG. 14 is sectional view along the line 14—14 of FIG. 13.
Figure 12:
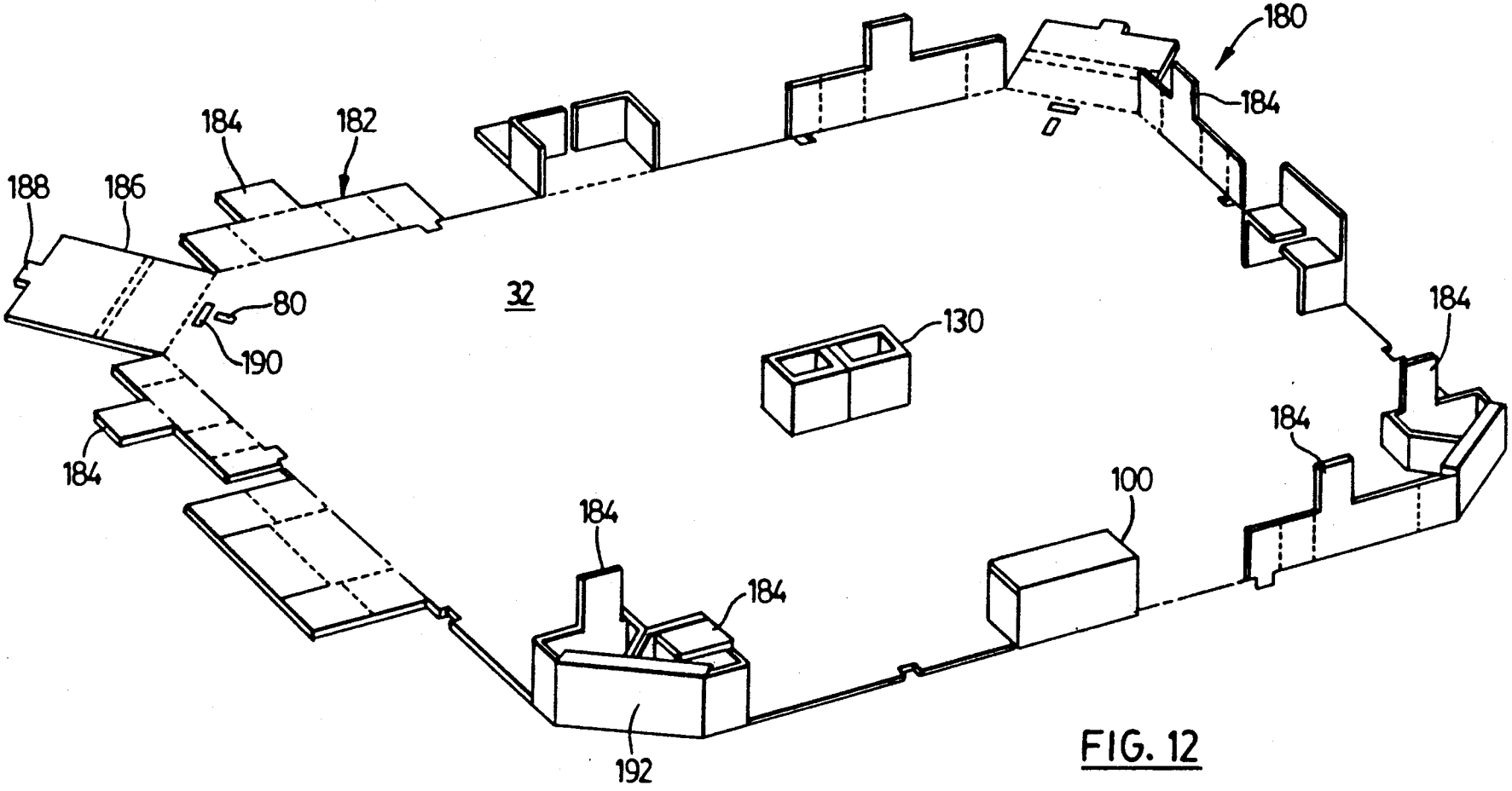
FIG. 12 is a perspective view of another cardboard blank prior to assembly into a second embodiment of a unitary pallet according to the present invention.
Figure 13:
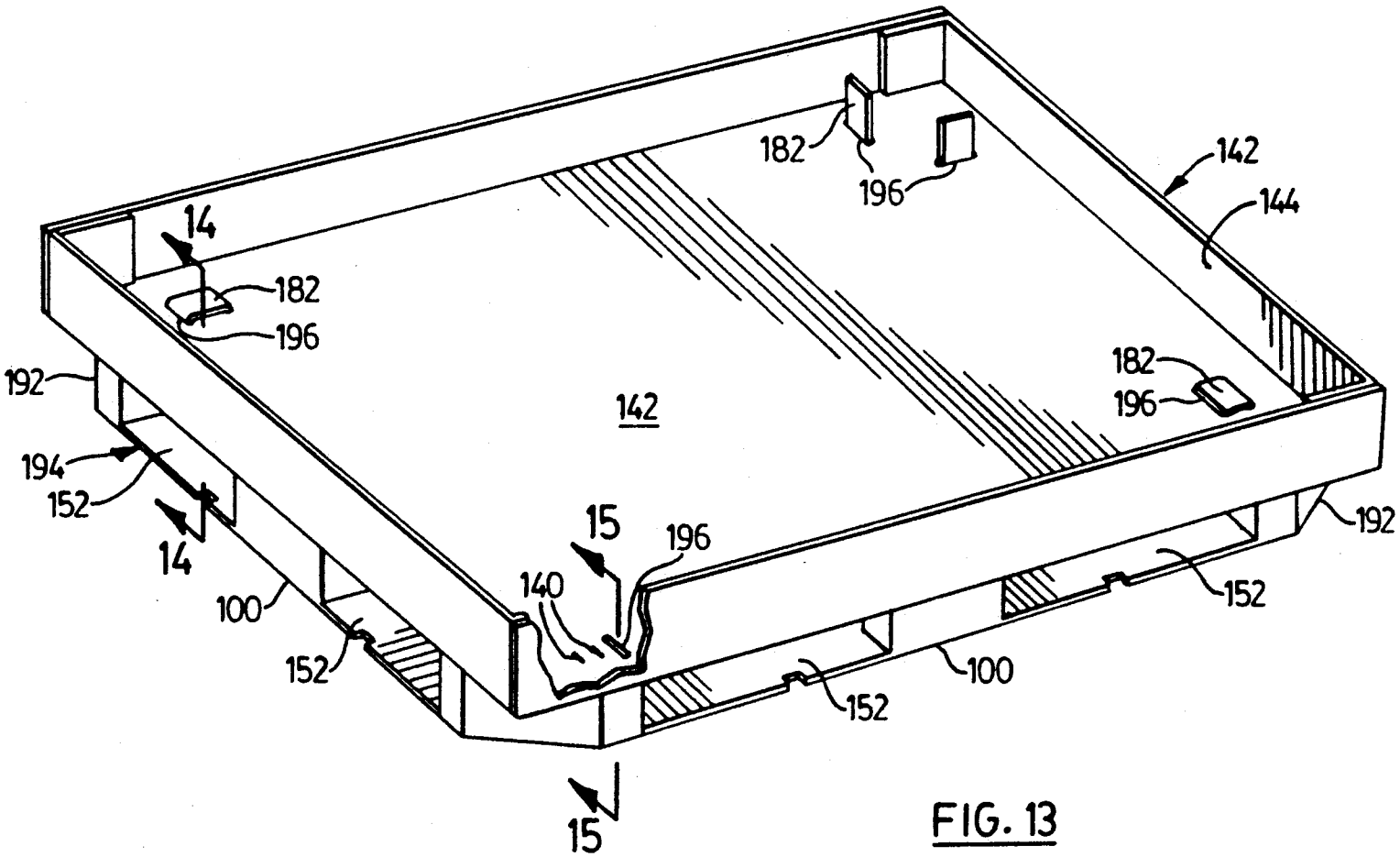
FIG. 13 is a perspective view, broken away, of a tray mounted on the assembled pallet base formed from the blank shown in FIG. 11.

An alternative embodiment of a unitary pallet base partially assembled from a blank 180 is shown in FIG. 12. Blank 180 is similar to blank 30 but with the following differences. Blank 180 is absent the triangular panels 112 present in blank 30 and side flaps 182 are not folded in half along the longitudinal direction but are cut as shown to provide a securing tab 184. In addition, corner panels 186 are cut as shown to provide locating tabs 188 on the free edges thereof spaced from the side edge of platform 32. An aperture 190 is located in each corner of platform 32 for receiving therein locating tab 188. Corner panels 186 are assembled to form corner support members 192. FIG. 13 shows the resulting assembled pallet base 194 with tray 142 attached thereto. Tray 142 may be attached to base 194 by inserting securing tabs 188 through slots 196 located in base 146 and securing them to the surface of the base using glue or other adhesive, see FIG. 14. Alternatively, tabs 182 may be folded to underlay base 146 of tray 142 with the tray being secured using either adhesives, glue or staples 148, as shown in the lower corner of the assembled pallet is best seen in the cross section of FIG. 15.

Figure 17:
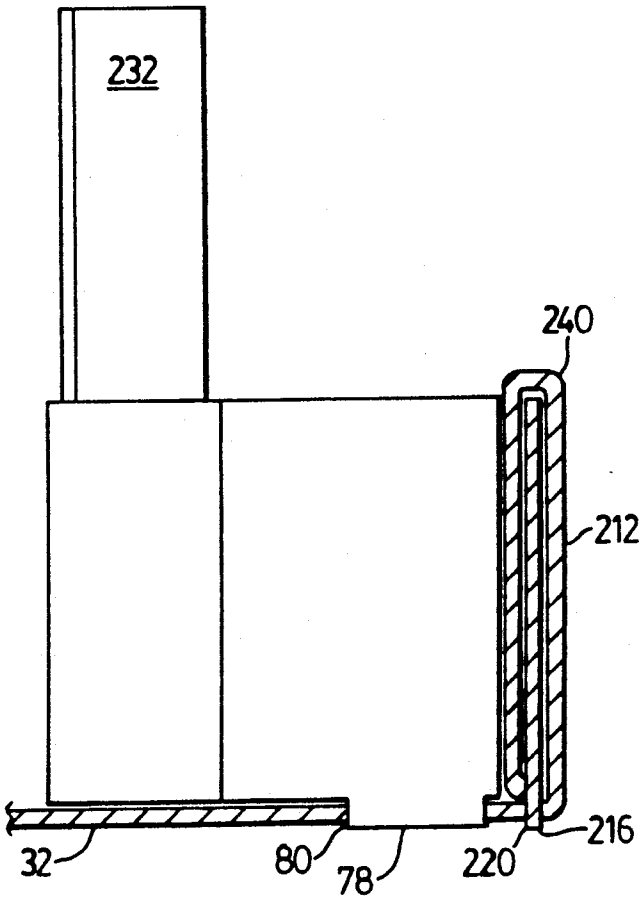
FIG. 17 is a sectional view along the line 17—17 of FIG. 16 after the corner has been folded.
Figure 16:
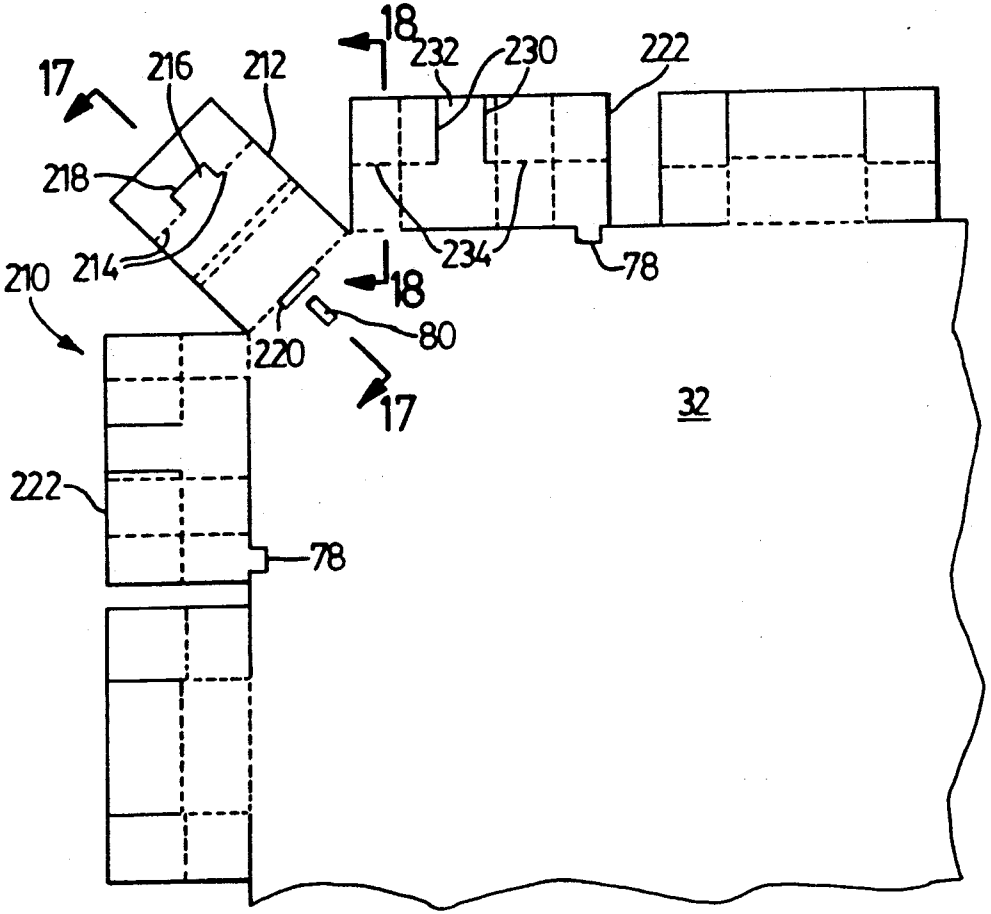
FIG. 16 is a plan view, broken away, of another cardboard blank prior to assembly into a third embodiment of the unitary pallet base according to the present invention.

Referring to FIG. 16, a corner portion 210 of a blank of another alternative embodiment of a unitary pallet base constructed in accordance with the present invention is illustrated. The pallet base blank of which corner portion 210 forms a part is similar to blank 180 of FIG. 12 but with the following differences. Corner panels 212 are foldable along fold lines 214 which are located on either side of a rectangular positioning tab 216 defined by a cut line 218 extending between the inner ends of fold lines 214. An aperture 220 is located in the corner of central platform 32 for receiving therein tab 216. End flaps 222 are provided with cut lines 230 defining rectangular tab 232 and colinear fold lines 234 extending longitudinally along the centre of flap 222 for folding the flap when the pallet base is assembled, best seen in the sectional view of FIG. 18. FIG. 17 illustrates a cross sectional view of assembled corner panel 212 to form a unitary corner support 240. The full use of panel 212 to provide the reinforced corner support 240 avoids needless waste of the paperboard material comprising the blank and avoids the use of a separate reinforcing or support member at the corners. It will be understood that the blank of FIG. 16 could also comprise tiangular panels similar to triangular panels 112 in blank 30 of FIG. 1 in another embodiment of the invention.

Referring now to FIG. 19, a corner portion 300 of a blank of another embodiment of a unitary pallet base constructed in accordance with the present invention is illustrated. The pallet base blank of which corner portion 300 forms a part is rectangular having a central deck or platform 302 and integral side flaps 304 and 306 on either side of the corners. Flap 304 extends between cut lines 308 and 310 and is provided with a longitudinally extending double fold line 312. Flap 304 comprises three spaced fold lines 314, 316 and 318 extending transversely thereacross. Flap 304 comprises a panel 326 located between cut line 308 and fold line 314. Flap 304 is separated from central portion 302 partly by a fold line 320 extending from the corner of central platform 302 and partly by a cut line 322 collinear with fold line 320 wherein cut line 322 defines positioning tab 324 adjacent the end of side edge portion 304.

Side portion 306 extends between cut lines 330 and edge 332 and is provided with a longitudinally extending single fold line 334. Side edge portion 306 comprises four spaced fold lines 336, 338 and 340 extending transversely thereacross with edge 332 and fold line 342 defining an end panel 350 therebetween. Edge portion 306 is separated from central portion 302 partly by a fold line 342 extending from the corner of central platform 302 and partly by a cut line 344 collinear with fold line 342 wherein cut line 344 defines positioning tab 346. An aperture 348 is located in each corner of central platform 302 for receiving therein positioning tabs 322 and 346.

Figures 21A, 21B, 21C, 21D, 21E, 21F:
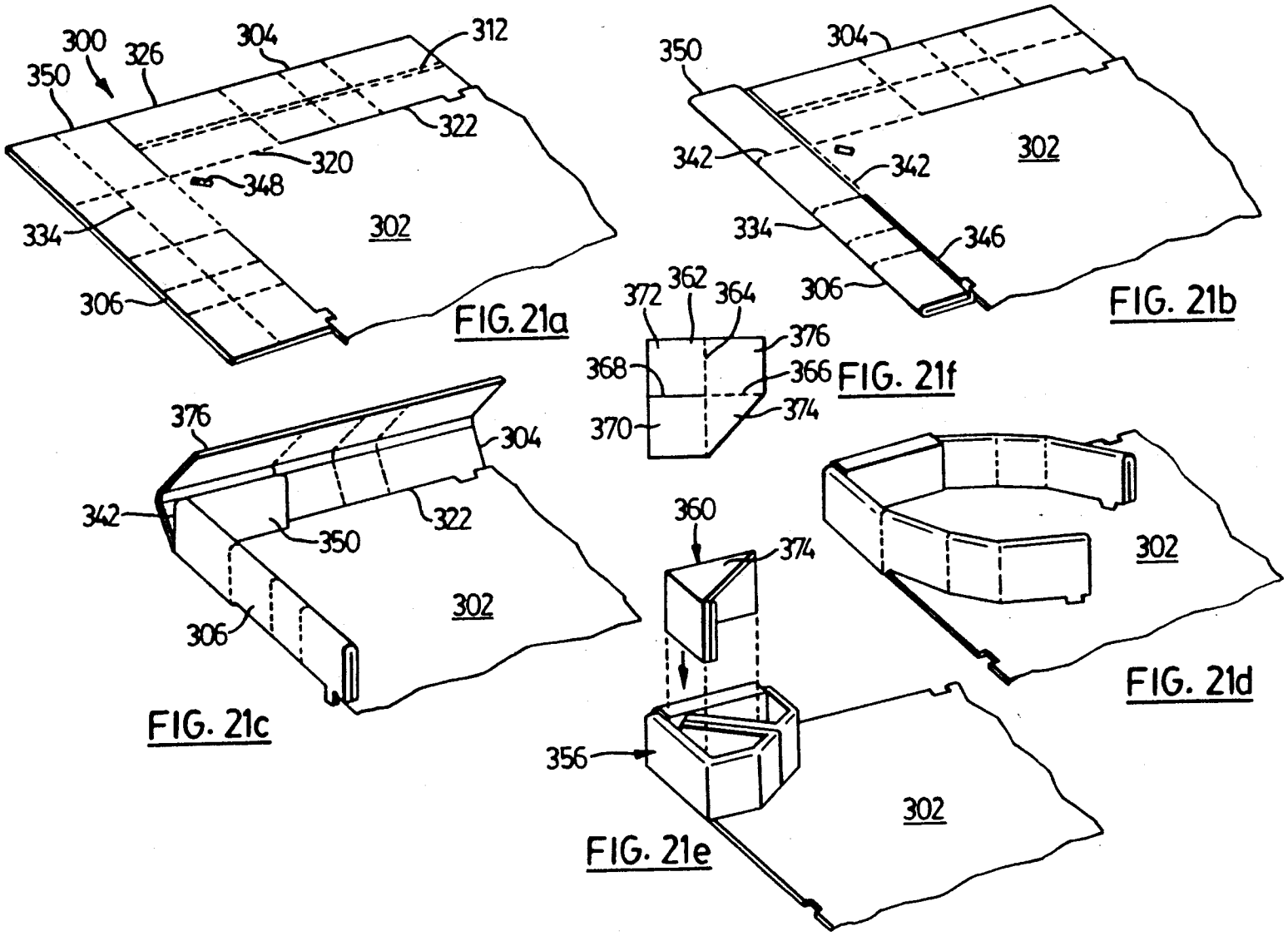
FIGS. 21*a* to 21*e* are perspective views of the blank shown in FIG. 18 and accessories in various stages of assembly of the corner support.

The various steps or stages in the folding of side edge portions 304 and 306 to form unitary corner support 356, best seen in FIGS. 20 and 21*e*, are illustrated in FIGS. 21*a* to 21*e*. Flap 306 is first folded along longitudinal fold line 334 with the outer longitudinal half of the flap folded to overlay the inner longitudinal half, see FIG. 21*b*. Referring to FIG. 21*c*, the resulting double thickness flap 306 is then folded upwardly along fold and cut lines 342 and 344 respectively followed by folding panel 350 inwardly toward central portion 302 along fold line 342. Flap 304 is then folded upwardly along fold line 320 and cut line 322 after which the outer longitudinal half of this flap is folded along double fold line 312 with panel 350 being sandwiched between the outer and inner sections of panel 326. The folded flaps 304 and 306 are then folded inwardly toward the corner of central platform 302 as shown in FIG. 21*d* with the outer panels laying adjacent each other with positioning tabs 324 and 346 inserted through aperture 348 to complete the assembly of corner support 356.

Referring specifically to FIGS. 21*e* to 21*g*, a corner cube-shaped reinforcing member 360 is formed from a blank 362 comprising fold lines 364, 366 and a cut line 368 collinear with fold line 366. Corner reinforcing member 360 is formed by folding blank 362 along the various fold and cut lines and gluing rectangular panel 370 to rectangular panel 372. The outer surfaces of 374 and 370 are coated with a fast drying glue and corner member 360 is then inserted into assembled corner support 356 to be glued to the adjacent panels of corner support 356. Triangular panel 376 provides a flat support surface to which a tray (not shown) similar to tray 142 in FIG. 11 may be either glued or stapled. The assembled pallet base of which FIG. 21*e* forms a part includes side edge supports similar to support 100 shown in FIG. 8 and a central support member similar to support member 130 shown in FIG. 8. The side edge supports 100, corner supports 356 and central support 130 all extend out the plane of central load bearing platform 32 in the same direction and substantially the same distance as the corner support members. The pallet blank is fabricated of a stiff foldable material which is preferably a corrugated cardboard to provide a lightweight, recyclable and economic pallet. While tray 142 has been illustrated as being rectangular it will be appreciated that it could have an octogonal shape to match the octogonally shaped pallet base embodiments.

Side edge support members 100 and central support member 130 in all the embodiments of the pallets disclosed herein may be dispensed with when the pallet is fabricated of a small enough size. As the pallet is scaled up in size, central support member 130 and side edge support members 100 are included to provide reinforcing strength in the centre and on the sides of the pallet.

It will be appreciated by those skilled in the art that the pallet and pallet base comprising the unitary corner and side support members provides several advantages. First, the fact that the corner and side support members are of one piece construction with the support platform (i.e. a unitary structure) results in an improved pallet since the supports are not easily knocked off the pallet by the forks of a fork lift truck. Further, unitary corner supports may be fabricated having different geometries tailored for different load weights, compare pentagonal corner support 356 of FIG. 21(*e*) with hexagonal corner support 120 of FIG. 8. Rigidly attaching tray 142 to the unitary pallet base significantly improves the beam strength of the tray which provides a stronger pallet when, for example, the pallet is being lifted by a fork-lift truck. This improved strength prevents sagging of the sides of the pallet tray under load and as the pallet is lifted above the supporting surface.

Another advantage of the unitary pallet base of the present invention is economic in nature relating to the fact that the pallet is constructed of one type of material and therefore dispenses with the need for reinforcing cores or cylinders separately attached to the pallet base. Further, corner and side supports forming part of the unitary base of the present invention may be reinforced in different ways depending on how the base blank portion is cut and folded and result in little wastage of cardboard material. The blanks illustrated in FIGS. 1, 16 and 21 illustrate three different ways of reinforcing the respective corner supports. The unitary pallet of the present invention, being fabricated of one type of material, is completely recyclable and does not require sorting or separating of different components as a prelude to recycling.

While the pallet support base employing unitary corner and side support members forming the subject invention has been illustrated and described with respect to various embodiments, it will be appreciated that numerous variations of these embodiments may be made without departing from the scope of the invention described herein.

I claim:

1. A pallet blank fabricated of a stiff foldable sheet material, comprising:

a central platform having corner portions and side edges, the central platform having first and second opposed surfaces, including a corner flap located at each corner portion of said central platform and at least two spaced side flaps attached to each side edge of said central platform, each side flap on each side edge having a first end adjacent a corner flap and a second end opposed to said first end, the corner flaps and side flaps being of one piece construction with said central platform, each side flap being attached to said central platform side edge along a first fold line extending from said first end to a first position spaced from said second end of the side flap, each side flap being detached from the central platform along a cut line extending from said first position to said second end, the corner flaps and the side flaps being foldable in the direction out of the plane of said central platform, each corner flap also being foldable to overlap itself, said corner flaps once so folded being securable in position to said central platform, the second ends of the side flaps being foldable toward and inwardly of the corner flap which is adjacent said side flaps, and once so folded being securable in position, wherein said foldable corner flap and the adjacent foldable side flaps form a corner support member extending out of the plane of said central platform when the blank is assembled into a pallet.

2. The pallet blank according to claim 1 wherein said central platform is rectangular, said corner flap being attached to one of said adjacent side flaps along the first end thereof and foldable with respect thereto, the corner flap and the side flap attached thereto being foldable along a fold line extending substantially parallel to the edge of the platform to which the side flap is attached, and the other adjacent side flap being foldable along a fold line extending substantially parallel to the edge of the platform to which said other side flap is attached, wherein when the blank is assembled the corner support member comprises said corner flap folded to overlay itself and folded with respect to the side flap to which it is attached to lay along the central platform edge to which the other adjacent side flap is attached, said other side flap being folded to partially overlay the folded corner flap and secured thereto.

3. The pallet blank according to claim 1 wherein said corner flap is foldably attached to said central platform along a corner portion fold line extending between ends of the two side edges located on either side of said corner flap, said corner fold line being at an angle with respect to said side edges thereby defining an octagonally shaped central platform.

4. The pallet blank according to claim 3 wherein said corner flap includes a corner flap positioning tab attached thereto, the central platform including a first aperture in each corner portion thereof for receiving therein said corner flap positioning tab.

5. The pallet blank according to claim 3 wherein said side flaps are foldable along a second fold line substantially parallel to said first fold line and spaced from said first fold line about half the width of said side flap so each side flap overlaps itself when the pallet is assembled, the overlapping portions of the flaps being attachable together.

6. The pallet blank according to claim 5 wherein said side flaps each include a portion projecting from said first end of said side flap toward the adjacent corner flap, the projecting portion being attached along said first end of the respective side flap and foldable therealong, wherein when the blank is assembled the corner support member comprises the two projecting portions adjacent each corner folded in such a way as to be aligned generally along said corner fold line, the corner flap being folded to overlay said projecting portions wherein said projecting portions reinforce said folded corner flap.

7. The pallet blank according to claim 3 wherein said side flaps are each provided with positioning tab members attached to an edge of said flap adjacent to the side edge of said central platform spaced from the second end of the flap, the central platform including a second aperture in each corner portion thereof for receiving therein said side flap positioning tab.

8. The pallet blank according to claim 3 wherein said corner flaps are each foldable along a plurality of spaced fold lines extending across the width of said corner flap and being parallel to said corner portion fold line to provide at least three flap panel portions, whereby when said corner support members are assembled each folded corner flap comprises three adjacent flap panel portions.

9. The pallet blank according to claim 2 including a separate central flap attached to each side edge of said central platform between the side flaps on said side edge, said separate central flaps being of one piece construction with said central platform, each central flap comprising fold and cut lines arranged in such a way that said central flap is foldable into a generally rectangular side support member extending out of the plane of said central platform in the same direction as said corner support members and being securable in position to said central platform.

10. The pallet blank according to claim 3 including a separate central flap attached to each side edge of said central platform between the side flaps on said side edge, said separate central flaps being of one piece construction with said central platform, each central flap comprising fold and cut lines arranged in such a way that said central flap is foldable into a generally rectangular side support member extending out of the plane of said central platform in the same direction as said corner support members and being securable in position to said central platform.

11. The pallet blank according to claim 9 including a central support member attachable to said first surface in the central portion thereof.

12. The pallet blank according to claim 10 including a central support member attachable to said first surface in the central portion thereof.

13. The pallet blank according to claim 2 including a pallet tray blank comprising a central load bearing platform attachable to said corner support members.

14. The pallet blank according to claim 3 including a pallet tray blank comprising a central load bearing platform attachable to said corner support members when said pallet blank is assembled into a load bearing pallet to form load bearing pallet.

15. The pallet blank according to claim 14 wherein said side flaps comprise securing tabs attached thereto, the assembled pallet tray being attachable to said securing tabs.

16. A pallet fabricated of a stiff foldable sheet material, comprising:

a) a generally rectangular central platform having corner portions and side edges, the central platform having opposed first and second surfaces; and b) a corner support member at each corner portion of said central platform comprising a combination of a corner flap located at each corner portion of said central platform and a side flap attached to the side edge of said central platform on each side of said corner flap, each side flap on each side edge having a first end located adjacent the corner flap and a second free end, the corner flaps and side flaps being of one piece construction with said central platform, each side flap being partially attached to said central platform side edge along a fold line extending from said first end to a first position spaced from said second end of the side flap, the corner flaps and the side flaps being folded in the same direction out of the plane of said central platform, wherein in the assembled combination each corner flap is folded to overlap itself and secured in a position to extend out of the plane of said central platform, the second free ends of the side flaps being folded toward and inwardly of the corner flap which is adjacent said side flaps and being secured to said central platform.

17. The pallet according to claim 16 wherein said central platform is rectangular, said corner flap being attached to the first end of one of said adjacent side flaps and folded with respect thereto to underlie the edge of the central platform to which the other adjacent side flap is attached, the corner flap and the side flap attached thereto being folded in such a way that the corner flap overlays itself and the side flap overlaps itself, and the other side flap adjacent said corner flap being folded to overlay said corner flap.

18. The pallet according to claim 16 wherein said corner flap is attached to said central platform along a corner portion fold line extending between ends of the two side edges located on either side of said corner flap, said corner fold line being at an angle with respect to said side edges thereby defining an octagonally shaped central platform.

19. The pallet according to claim 18 wherein said corner flap includes a corner flap positioning tab attached thereto, the central platform including a first aperture in each corner portion thereof for receiving therein said corner flap positioning tab.

20. The pallet according to claim 18 wherein said side flaps are folded along a second fold line substantially parallel to said first fold line and spaced therefrom about half the width of said side flap so each side flap overlaps itself when the pallet is assembled, the overlapping portions of the flaps being attached together.

21. The pallet according to claim 20 wherein said side flaps each include a portion projecting from said first end toward the first end of the other side flap on the other side of the corner portion, the corner flap being folded to sandwich therebetween said projecting portions.

22. The pallet according to claim 18 wherein said side flaps are each provided with positioning tab members attached to an edge of said flap adjacent to the first surface of said central platform, the central platform including a second aperture in each corner portion thereof for receiving therein said side flap positioning tab.

23. The pallet according to claim 18 wherein said corner flaps are each folded along a plurality of spaced fold lines extending across the width of said corner flap and being parallel to said corner portion fold line to provide at least three contiguous flap panel portions.

24. The pallet according to claim 17 including side support members attached to each side edge of said central platform spaced between the corner support members, said side support members being of one piece construction with said central platform, each side support member comprising a central flap folded to provide a generally rectangular side support member extending out the plane of said central platform in the same direction as said corner support members and being securable in position to said central platform.

25. The pallet according to claim 18 including side support members attached to each side edge of said central platform spaced between the corner support members, said side support members being of one piece construction with said central platform, each side support member comprising a central flap folded to provide a generally rectangular side support member extending out the plane of said central platform in the same direction as said corner support members and being securable in position to said central platform.

26. The pallet according to claim 24 including a central support member attached to said central platform in the central portion thereof, the central support member extending substantially the same distance and same direction away from the central platform as the corner members extend from the central platform.

27. The pallet according to claim 25 including a central support member attached to said central platform in the central portion thereof, the central support member extending substantially the same distance and same direction away from the central platform as the corner members extend from the central platform.

28. The pallet according to claim 17 including a pallet tray comprising a central load bearing platform attached to said corner support members.

29. The pallet according to claim 18 including a pallet tray comprising a central load bearing platform, the pallet tray being attached to said corner support members.

30. The pallet according to claim 29 wherein said side flaps comprise securing tabs attached thereto, the pallet tray being attached to said securing tabs.

* * * * *